US007316359B2

(12) United States Patent
Beidokhti

(10) Patent No.: US 7,316,359 B2
(45) Date of Patent: Jan. 8, 2008

(54) MULTI-SPRAY MULTI-LIGHT FOUNTAIN

(76) Inventor: Noorolah Nader Beidokhti, 16757 Maple St., Fountain Valley, CA (US) 92708

( * ) Notice: Subject to any disclaimer, the term of this patent is extended or adjusted under 35 U.S.C. 154(b) by 3 days.

(21) Appl. No.: 11/120,047

(22) Filed: May 2, 2005

(65) Prior Publication Data

US 2006/0243819 A1 Nov. 2, 2006

(51) Int. Cl.
*F21S 8/00* (2006.01)

(52) U.S. Cl. ..... 239/18; 239/17; 239/20; 239/16; 362/96; 362/101; 362/268; 362/373

(58) Field of Classification Search ..... 239/18, 239/17, 16, 20, 23, DIG. 15; 362/96, 101, 362/267, 268, 373, 362, 293
See application file for complete search history.

(56) References Cited

U.S. PATENT DOCUMENTS 1,837,732 A * 12/1931 Stabler ..... 239/18
2,745,697 A * 5/1956 Pearse ..... 239/20
3,542,292 A * 11/1970 Chase ..... 239/20
3,838,816 A * 10/1974 Huff et al. ..... 239/18
5,207,499 A * 5/1993 Vajda et al. ..... 362/96
6,375,090 B1 * 4/2002 Beidokhti ..... 239/17
6,659,626 B1 * 12/2003 Markey et al. ..... 362/640
6,949,894 B1 * 9/2005 Sullivan et al. ..... 315/362

* cited by examiner

*Primary Examiner*—Dinh Q. Nguyen
(74) *Attorney, Agent, or Firm*—Roy A. Ekstrand

(57) ABSTRACT

A housing suitable for partial immersion in a pool or pond supports a plurality of electric lamps together with a plurality of fountain nozzles. The fountain nozzles are coupled to a nozzle flow distributor which is operative to direct water flow to one or more of the nozzles selectively. The directing of flow is accomplished by a motor-driven flow distributor operative under an electric module control. A plurality of electric lamps are supported within respective lamp assembly receptacles which in turn provide a flow of cooling water to maintain the lamp assemblies at a safe operating temperature.

15 Claims, 18 Drawing Sheets

MULTI-SPRAY MULTI-LIGHT FOUNTAIN

FIELD OF THE INVENTION

This invention relates generally to fountains and particularly to improved fountain systems which utilize one or more electrically driven pumps to provide pressurized fountain sprays of water or other liquids.

BACKGROUND OF THE INVENTION

The general concept of fountains and fountain displays is well established in the art. Fountains have exsisted from earliest recorded history and have been the subject of substantial creativity and artistic expression. Thus, early fountains were often intricately sculptured and replete with various sculpted figures and sculpted objects. Earliest fountains were typically gravity powered in that water from a higher location was allowed to flow downwardly across the fountain structure in what is generally describable as a cascade. With the advent of pumping devices, some of which were human or animal powered while others were driven by wind power apparatus, fountains and fountain displays obtain the added feature of water sprays or streams of upwardly or angularly directed water under pressure. Practitioners in the art placed considerable emphasis upon creativity in providing aesthetically pleasing flow patterns of sprays and water streams.

As electrical pumps and electrical control systems became generally available, practitioners in the art provided ever more complex displays and fountain systems. Often such fountain systems employed moving nozzles to direct spray through various movement or "dancing" pattern activities. In addition, the use of electrical pumps and pump control systems provided for the additional aesthetic elements for fountain systems such as variations of fountain pressure to alter the fountain spray or water stream heights. Further development of electrical pumping systems provided for displays having multiple changing spray patterns together with multiple cascades.

The continued development of electrical pumping systems also brought added capability to fountains. Basically, fountains were now able to incorporate different types of cleaning and filtering apparatus as a quantity of water is circulated in a closed circulation system through the fountain. The implementation of electronic controllers to further control electrical pumping systems within fountains added further flexibility and capability. Additional elements such as light and sound features provided still further creativity for fountains and fountain displays.

As a result of substantial development in the art, modern fountains have become available in sizes ranging from simple small fountains suitable for a residence or small housing complex to large and complex fountains and fountain displays suitable for public parties or entertainment facilities.

Despite the substantial effort and improvement by practitioners in the art in creating ever more improved fountains and fountain systems, there remains nonetheless a continuing need in the art for ever more improved efficient and entertaining fountains and fountain display systems.

SUMMARY OF THE INVENTION

Accordingly, it is a general object of the present invention to provide an improved multi-spray multi-light fountain system. It is a more particular object of the present invention to provide an improved multi-spray multi-light fountain system which is suitable for use in environments having a ready source under pressure as well as environments requiring an on-board pump within the fountain unit. It is a still further object of the present invention to provide an improved multi-spray multi-light fountain which may be placed within an otherwise unadorned body of water such as a pond or pool and without further modification to the environment produce an entertaining and interesting fountain and light display.

In accordance with the present invention, there is provided a floating fountain for use in a water environment such as a pool or pond, the fountain comprising: a housing defining an upper edge and an interior cavity; an upper plate secured to the upper edge defining a plurality of lamp receptacles; a plurality of lamp assemblies each having a lamp housing and a lamp therein; a plurality of colored lenses and means for supporting the lenses above the upper plate in general alignment with the lamps, the colored lenses, the upper plates and the means for supporting constructed to provide a cooling water flow path into the lamp receptacles; a plurality of upwardly directed spray nozzles; and means for directing water under pressure to the spray nozzles.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

Figure 1A:
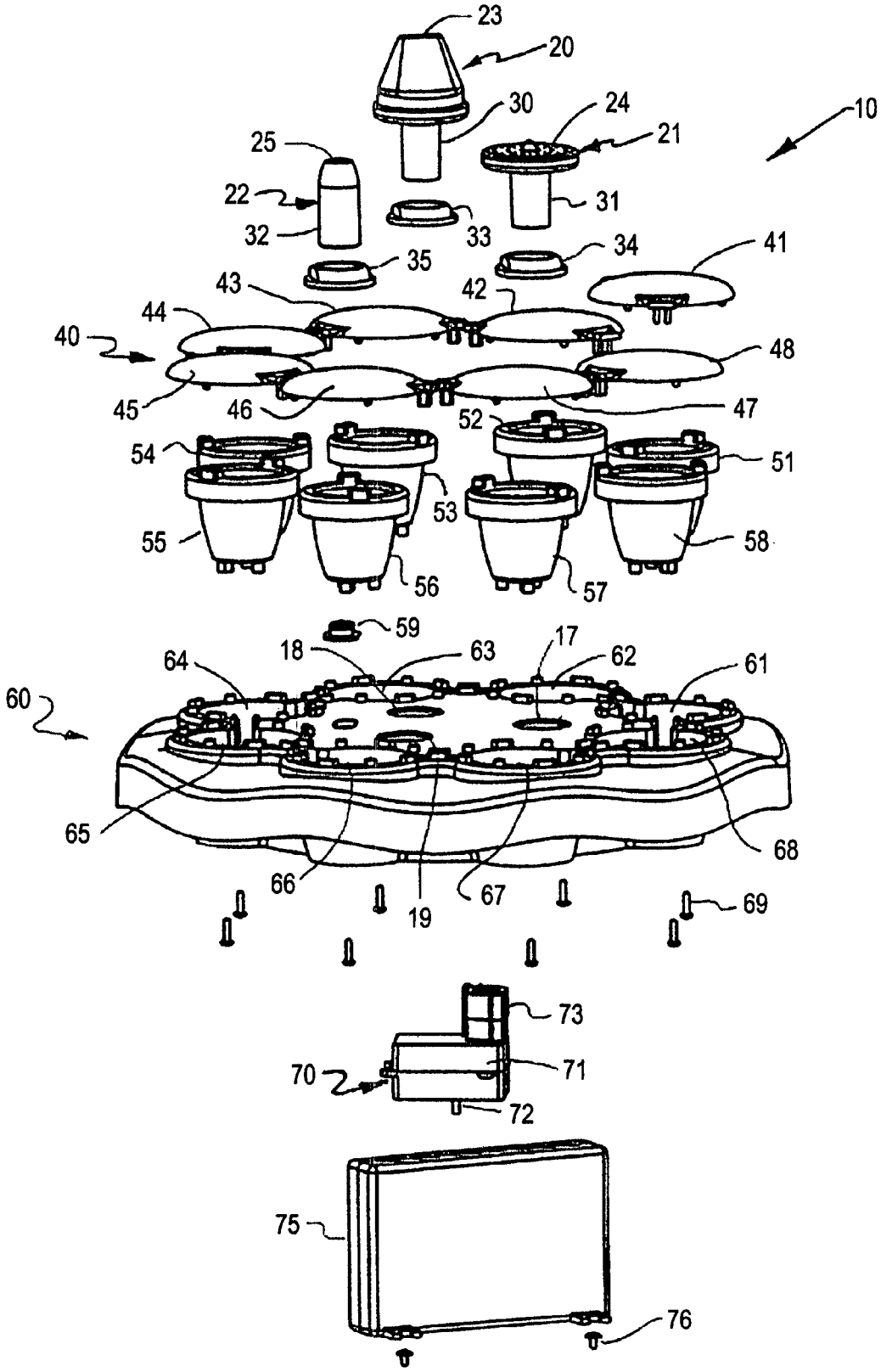
FIGS. 1A and 1B taken together set forth a perspective assembly view of an improved fountain constructed in accordance with the present invention suitable for use with a source of water under pressure.
Figure 1B:
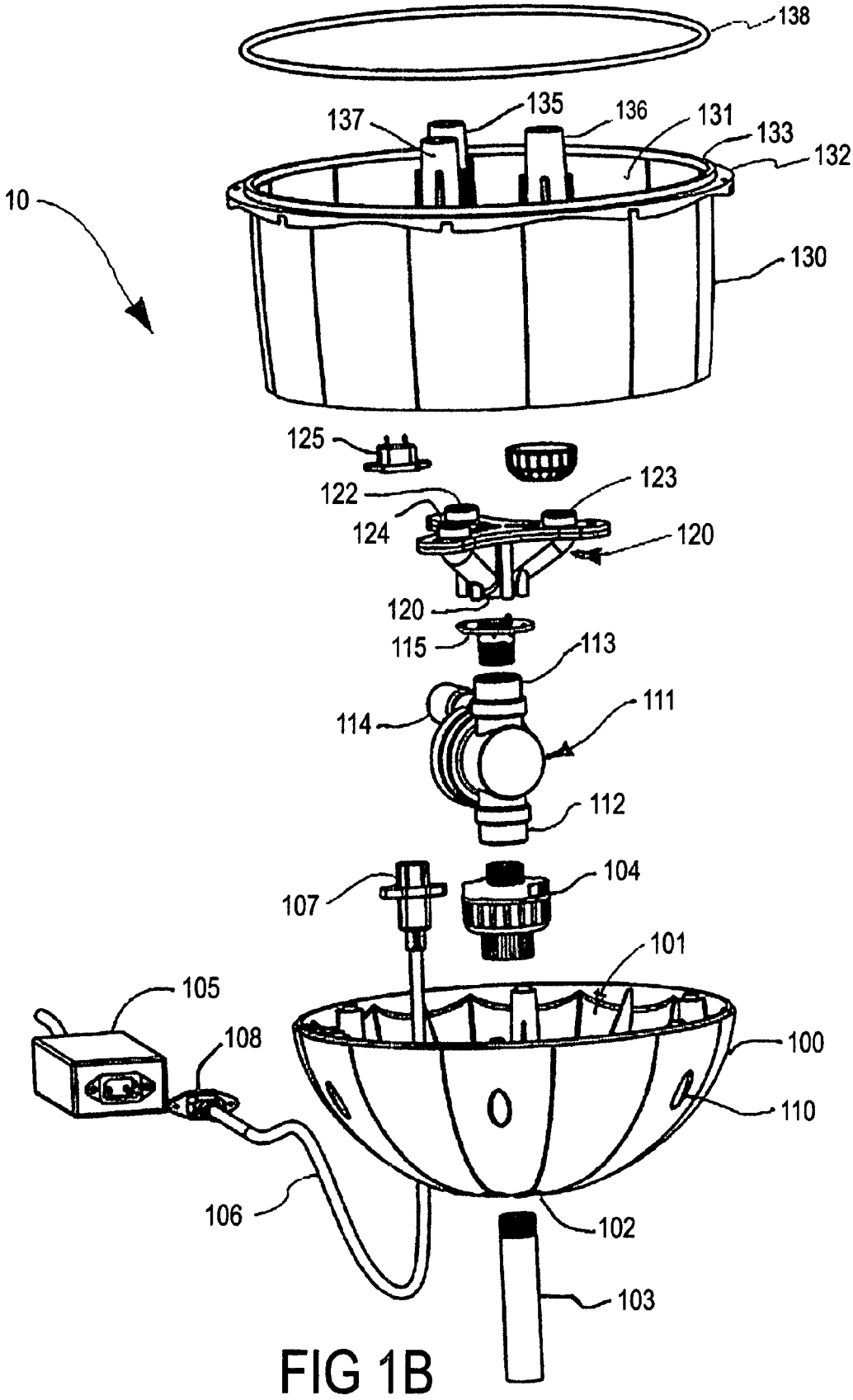

FIGS. 1A and 1B taken together set forth a perspective assembly view of the present invention improved fountain generally referenced by numeral 10. The upper portion of fountain 10 is shown in perspective assembly in FIG. 1A while the lower portion thereof is set forth in perspective assembly in FIG. 1B.

With particular attention to FIG. 1A, fountain 10 includes an upper plate 60 preferably formed of a molded plastic material or the like which defines for the most part the upper surface of fountain 10. Upper plate 10 is shown in greater detail in FIG. 10. However, suffice it to note here that upper plate 60 defines a plurality of lamp receptacles 61 through 68 integrally formed within the molded plastic material of upper plate 60. Upper plate 60 further defines a plurality of apertures 17, 18 and 19 which are used to receive the fountain nozzles of the present invention. As is described below in greater detail, lamp receptacles 61 through 68 are interconnected by waterflow passages to facilitate the flow of cooling water in and about the lamp assemblies of the present invention.

Fountain 10 further includes a plurality of lamp assemblies 51 through 58. Lamp assemblies 51 through 58 are set forth in greater detail in FIGS. 8 and 9 below. Suffice to note here that lamp assemblies 51 through 58 are received within receptacles 61 through 68 of upper plate 60 and are secured therein by a plurality of fasteners 69. An on/off switch 59 provides the user with direct manual control of the power-up of the fountain. Once again, lamp assemblies 51 through 58 are set forth below in FIGS. 8 and 9 in greater detail. However, suffice it to note at this point that each of lamp assemblies 51 through 58 receives and supports an electric lamp preferably of the type generally referred to as a "flood light or spotlight" which function to provide beams of light directed upwardly from lamp assemblies 51 through 58.

Figure 11:
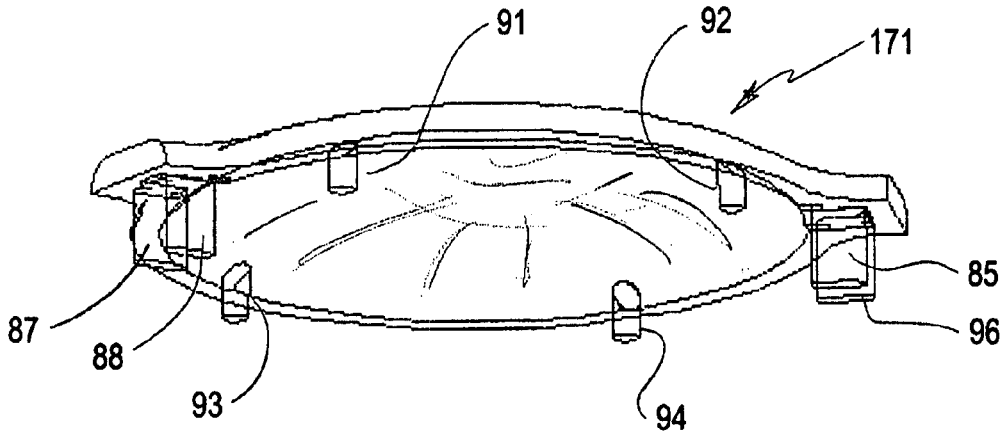
FIG. 11 sets forth a lower perspective view of the under side of a typical lens element.

Fountain 10 further includes a colored lens assembly 40 having a plurality of generally convex transparent colored lens 41 through 48. Lens 41 through 48 are preferably formed of color tinted molded plastic material and are joined at their respective edges to form a single one-piece lens assembly. It will be apparent from examination of FIG. 1A that colored lens assembly 40 is formed of a plurality of lenses 41 through 48 each shaped as shown in FIG. 11 and each configured to maintain lenses 41 through 48 in alignment with lamp housings 51 through 58 when housings 51 through 58 and lenses 41 through 48 are assembled within receptacles 61 through 68 and secured to upper plate 60. Once assembled, lenses 41 through 48 provide individual colored light lens for each of the lamps within lamp assemblies 51 through 58 respectively. A plurality of fountain nozzles 20, 21 and 22 are assembled to upper plate 60 by a plurality of threaded fasteners 33, 34 and 35. Nozzles 20, 21 and 22 each include respective nozzle apertures 23, 24 and 25. Nozzles 20 and 22 utilize a single nozzle aperture while nozzle 21 utilizes a "sprayhead" configuration having a plurality of apertures formed therein. Nozzles 20, 21 and 22 further include respective nozzle tubes 30, 31 and 32 which are received within apertures 17, 18 and 19 of upper plate 60 respectively. A plurality of threaded fasteners 33, 34 and 35 are positioned on the underside of upper plate 60 and threadably engaged the portions of nozzle tubes 30, 31 and 32 extending through apertures 17, 18 and 19 to secure nozzles 20, 21 and 22 in place.

Distribution drive unit 70 includes a gear drive 71 supporting a drive motor 73. Motor 73 is coupled to an output drive 72 by a plurality of drive gears within gear drive 71 (not shown) which are fabricated in accordance with conventional fabrication techniques. Thus, when drive motor 73 is energized, power is transmitted through the gears within gear drive 71 to rotate drive shaft 72. The function of distribution drive unit 70 is described below in greater detail. Suffice it to note here that distribution drive unit 70 is used to direct water flow between nozzles 21 through 22. A control module 75 includes electronic control circuitry which is operative to control the various light and spray functions of fountain 10.

With specific reference to FIG. 1B, fountain 10 includes a lower housing 100 defining a generally hemispherical shape having an upwardly open interior cavity 101. Lower housing 100 further defines a plurality of apertures 110 within its hemispherical walls and a center aperture 102. Center aperture 102 is received upon a water supply pipe 103. Supply pipe 103 is coupled to a source of pressurized water within the host fountain or pool and thus is coupled to the existing pump system. As a result, fountain 10 does not require a pump of its own in the embodiment set forth in FIGS. 1A and 1B. The upper end of supply pipe 103 extending through center aperture 102 is joined to a conventional coupler 104. An on/off water flow valve 111 includes an input 112 coupled to supply pipe 103 by coupler 104 and an output 113. Valve 111 further includes an electrical input connection 114 which is coupled to control module 75 (seen in FIG. 1A) by conventional wiring (not shown). Output 113 is joined to a coupler 115 which in turn defines an upper flange for receiving the lower portion of a nozzle flow distributor 120. Nozzle flow distributor 120 is set forth below in FIGS. 2 and 3 in greater detail. However, suffice it to note here that distributor 120 defines a single input 121 coupled to the output flow of valve 111 and coupler 115 together with a trio of water flow outputs 122, 123 and 124.

Fountain 110 further includes a plurality of nozzle feed tubes 135, 136 and 137 which are coupled to distributor outputs 122, 123 and 124 respectively. A plug receptacle 125 receives power plug 107 and is operatively coupled to control module 75 (seen in FIG. 1A). Plug 107 is coupled to power cord 106 which in turn supports an input plug 108. The latter is joined to a convenient power supply 105 which will be understood to comprise a convenient output of conventional operative electrical power.

An upper housing 130 defines a generally cylindrical shape having a generally cylindrical interior cavity 131. Upper housing 130 further defines an upper flange 132 and a seal rim 133. A resilient circular seal 138 resembling a large "O-ring" is received upon upper flange 132 and is generally located upon flange 132 by seal rim 133.

Thus, with simultaneous reference to FIGS. 1A and 1B, fountain 10 is assembled by initially placing lower housing 100 upon supply pipe 103 extending through center aperture 102. Thereafter, power cord 106 is passed through a convenient aperture in lower housing 100. Next, coupler 104 is joined to supply pipe 103 afterwhich valve 111 is secured to coupler 104. Coupler 115 is joined to output 113 of valve 111 afterwhich input 121 of distributor 120 is joined to the upper flange of coupler 115.

Upper housing 130 is positioned upon the upper edge of lower housing 100 and secured thereto. With upper housing 130 in place, nozzle feed tubes 135, 136 and 137 are joined to distributor outputs 122, 123 and 124 respectively. At this point, seal 138 is positioned about seal rim 133 and lies upon upper flange 132. Thereafter, control module 75 is secured within upper housing 130 and, by conventional electrical wiring (not shown), is operatively coupled to power cord 106 as well as connection 114 of valve 111. With module 75 in place, distribution drive unit 70 is secured within upper housing 132 such that drive shaft 72 is coupled to aperture 125 of nozzle flow distributor 120 (aperture 125 better seen in FIG. 2). With module 75 and distribution drive unit 70 secured within upper housing 130, electrical connection is made between drive motor 73 and control module 75 using conventional wiring and connection techniques (not shown). With housing 130 in place, upper plate 60 is positioned upon seal 138, rim 133 and upper flange 132 and is secured thereto by a plurality of threaded fasteners 69. Lamp assemblies 51 through 58 are positioned within lamp receptacles 61 through 68 respectively and secured therein. Electrical connection is made between control module 75 and lamp assemblies 51 through 58 utilizing a plurality of seals (not shown). With lamp assemblies 51 through 58 in place within receptacles 61 through 68, lenses 41 through 48 of colored lens assembly 40 are positioned upon the upper surface of upper plate 60 such that lenses 41 through 48 overlie the upper portions of lamp assemblies 51 through 58. Lenses 41 through 48 of colored lens assembly 40 are secured to upper plate 60 to define a space between the bottom edges of lenses 41 through 48 (such as space 79 seen in FIG. 4) which allow cooling water descending from the spray nozzles unto plate 60 to flow into the lamp receptacles.

Nozzle feed tubes 135, 136 and 137 are positioned within apertures 17, 18 and 19 and secured to upper plate 60 by attachments 33, 34 and 35.

Because of the alignment provided between apertures 17, 18 and 19 and nozzle feed tubes 135, 136 and 137 respectively, the attachment of upper plate 60 to upper housing 30 allows nozzles 21, 22 and 23 can be press fitted to nozzle feed tubes 135, 136 and 137.

Figure 2:
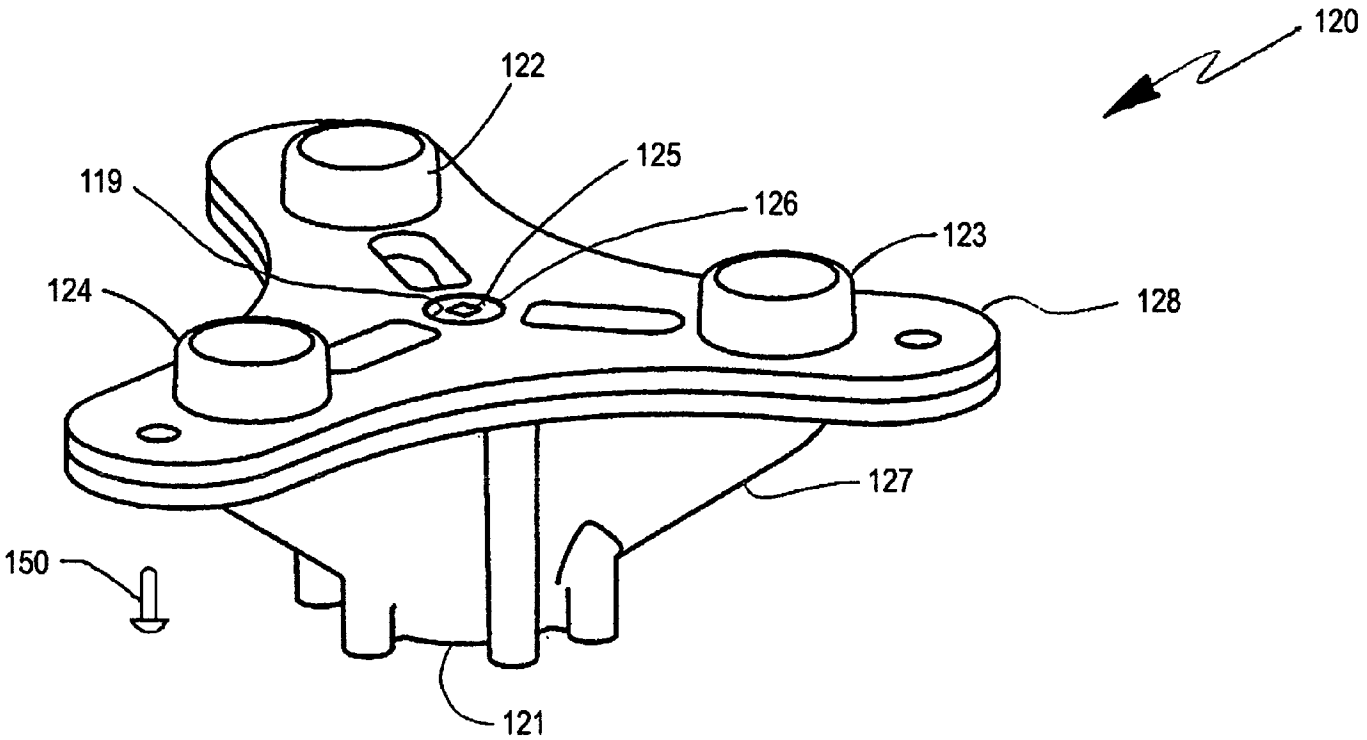
FIG. 2 sets forth a perspective view of the water flow distribution apparatus used in the present invention improved fountain.

FIG. 2 sets forth a perspective view of nozzle flow distributor 120. Nozzle flow distributor 120 provides a flow direction of water under pressure received at the input 121 between outputs 122, 123 and 124. As mentioned above, distributor 120 is operated by distribution drive unit 70 (seen in FIG. 1A). More specifically, nozzle flow distributor 120 includes a housing 127 having an input port 121 on the bottom edge thereof. Housing 127 further supports an output plate 128 which is secured to housing 127 by conventional attachment such as sonic welding or adhesive attachment.

With output plate 128 secured to the upper flange of housing 127, the rotation of flow control rotor 126 selects the water flow path between input 121 and a selected one of outputs 122, 123 and 124.

Figure 3:
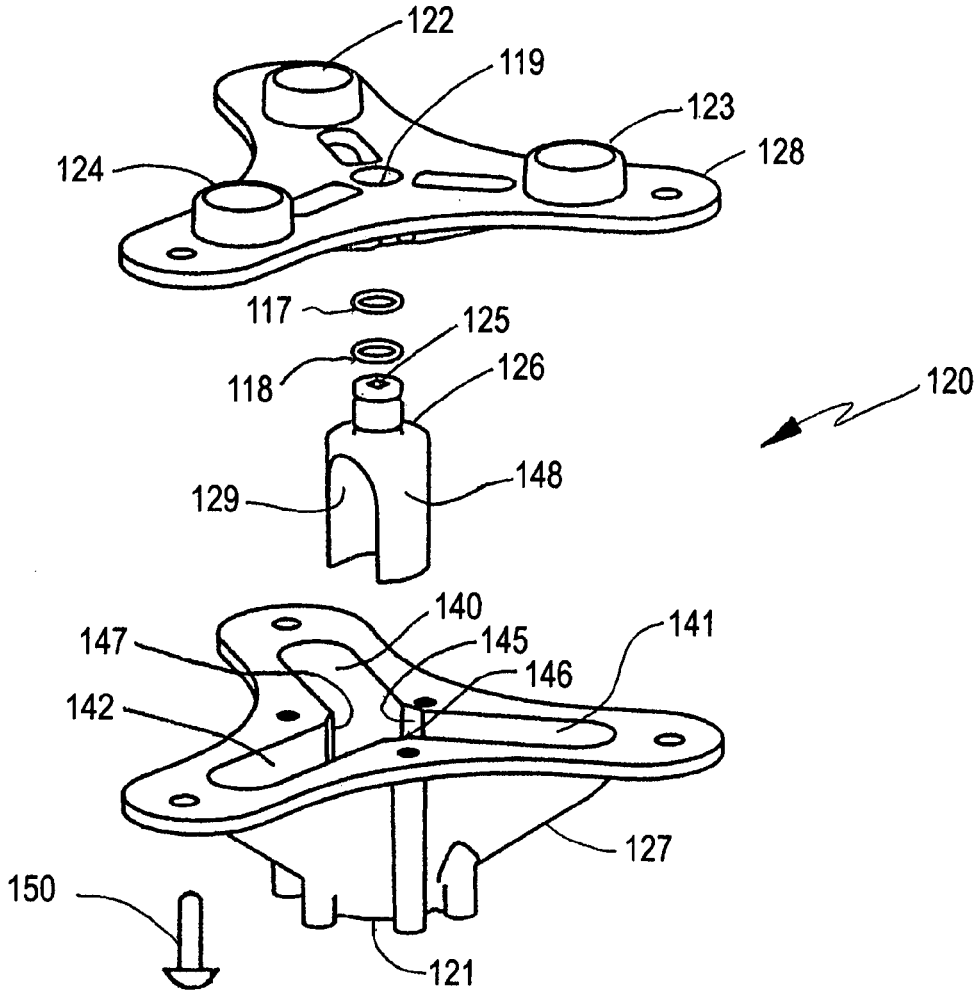
FIG. 3 sets forth a perspective assembly view of the water flow distribution unit shown in FIG. 2.

FIG. 3 sets forth a perspective assembly view of nozzle flow distributor 120. The operation of nozzle flow distributor 120 provides selective water flow distribution between a common input 121 and a trio of outputs 122, 123 and 124.

More specifically, nozzle flow distributor 120 includes a housing 127 having an input port 121 on the bottom edge thereof. Housing 127 further supports an output plate 128 which is secured to housing 127 by conventional sonic welding or adhesive attachment. Fasteners 150 secure nozzle flow distributor 120 to the underside of plate 60.

Housing 127 further defines a three-lobed channel combination 140, 141 and 142 all in communication with input 121. Housing 127 further defines a trio of seal edges 145, 146 and 147 between channels 140, 141 and 142. Distributor 120 further includes a flow control rotor 126 having a generally cylindrical outer surface 148 and defining a single channel 129 formed therein. Channel 129 extends partially through flow control rotor 126 and thus defines one open portion at its bottom and one open portion at one side. Flow control rotor 126 further includes a generally cylindrical upper portion which is received within aperture 119 of plate 128. A pair of resilient O-ring seals 117 and 118 are received upon the upper portion of flow control rotor 126 to provide a liquid seal within aperture 119. Flow control rotor 126 defines an aperture 125 at its upper end. As is better seen in FIG. 2, aperture 125 is accessible from the upper surface of distributor 120 and receives drive shaft 72 of distribution drive unit 70 (seen in FIG. 1A).

During assembly, flow control rotor 126 is positioned within housing 127 such that cylindrical surface 148 is in contact with one or more of edges 145, 146 and 147 depending upon the rotational position of flow control rotor 126. Thereafter, plate 128 is secured to housing 127 completing the fabrication of distributor 120. It will be apparent that as flow control rotor 126 is rotated, the direction of fluid flow path provided by channel 129 is selectively chosen between lobes 140, 141 and 142. This resulting flow is, as a result, selectively coupled between input 121 and a selected one of outputs 122, 123 and 124.

Figure 4:
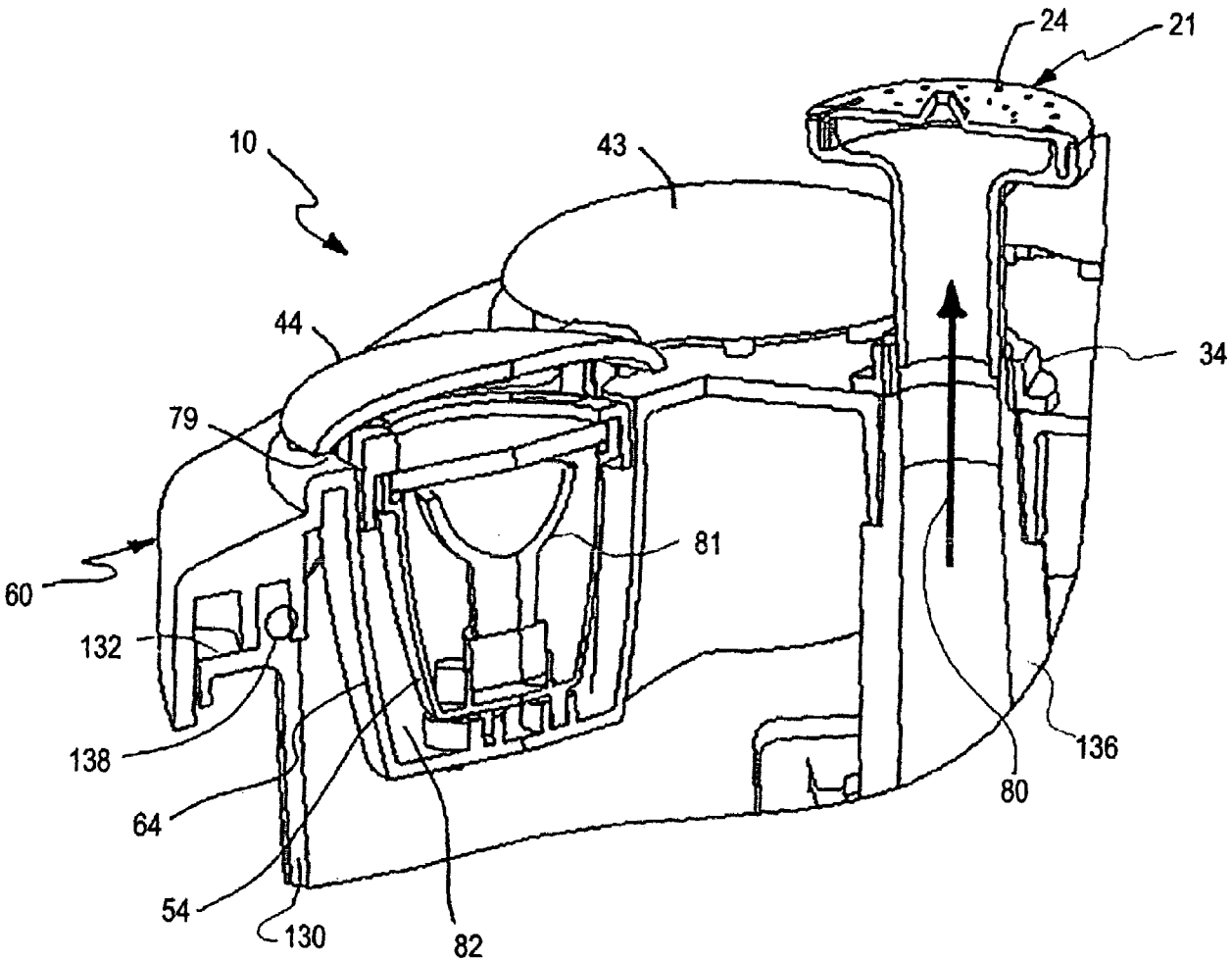
FIG. 4 sets forth a partial section perspective view of the upper portion of the present invention improved fountain with particular attention to the light assembling cooling apparatus.

FIG. 4 sets forth a partial section view of fountain 10 showing the structure of nozzle 21 in a press fit and the water cooling apparatus utilized in providing cooling of the lamp housings within fountain 10. It will be apparent to those skilled in the art from the descriptions above that the section view of FIG. 4 shows the structure of receptacle 64 having lamp housing 54 supported therein. However, it will be equally apparent to those skilled in the art that lamp receptacles 61 through 68 as well as lamp assemblies 51 through 58 (seen in FIG. 1A) are identical in structure and fabrication. Thus, the descriptions provided in conjunction with FIG. 4 are equally applicable to lamp assemblies 51 through 58 and lamp receptacles 61 through 68.

More specifically with reference to FIG. 4, fountain 10 includes an upper housing 130 which supports an upper plate 60 in the above-described attachment. Upper housing 130 defines an upper flange 132 which supports a resilient seal 138 and which forms an attachment to upper plate 60. A lamp receptacle 64 is integrally formed within upper plate 60 and is in communication with the water present within upper housing 130 in the manner described below. Lamp assembly 54 which supports a conventional lamp 81 is supported within lamp assembly 54 and is secured within a water tight environment in the manner described below. Suffice it to note here that the heat generated by lamp 81 is communicated to the outer surface of lamp assembly 54 and is transferred to cooling water flowing within cooling space 82 between the interior surface of receptacle 64 and the outer surface of lamp assembly 54.

FIG. 4 also shows nozzle feed tube 136 coupled to nozzle 21 in a press fit as described above. Nozzle 21 includes a plurality of spray apertures 24. As is also described above, a plurality of colored or tinted lenses such as lenses 43 and 44 are supported upon upper plate 60 and overlie each of the lamp receptacles formed in upper plate 60. The coupling of nozzle feed tube 136 to nozzle 21 allows water directed by nozzle flow distributor 120 (seen in FIG. 1B) to flow upwardly in the direction indicated by arrow 80 and emerge as a spray from the upper portion of nozzle 21 via apertures 24. The press fit attachment of nozzles 21, 22 and 23 allows the user to remove and replace nozzles without disassembly of the fountain and without the use of tools.

The utilization of the water environment within which fountain 10 is operative to provide cooling of the lamp assemblies within the present invention fountain provides a distinct advantage over other lighted fountains. The presence of cooling water in proximity to the sealed lamp assemblies allows greater time of operation without damage to the unit. It also facilitates the use of higher wattage lamps to achieve a more dramatic effect due to this increased efficient cooling.

Figure 5:
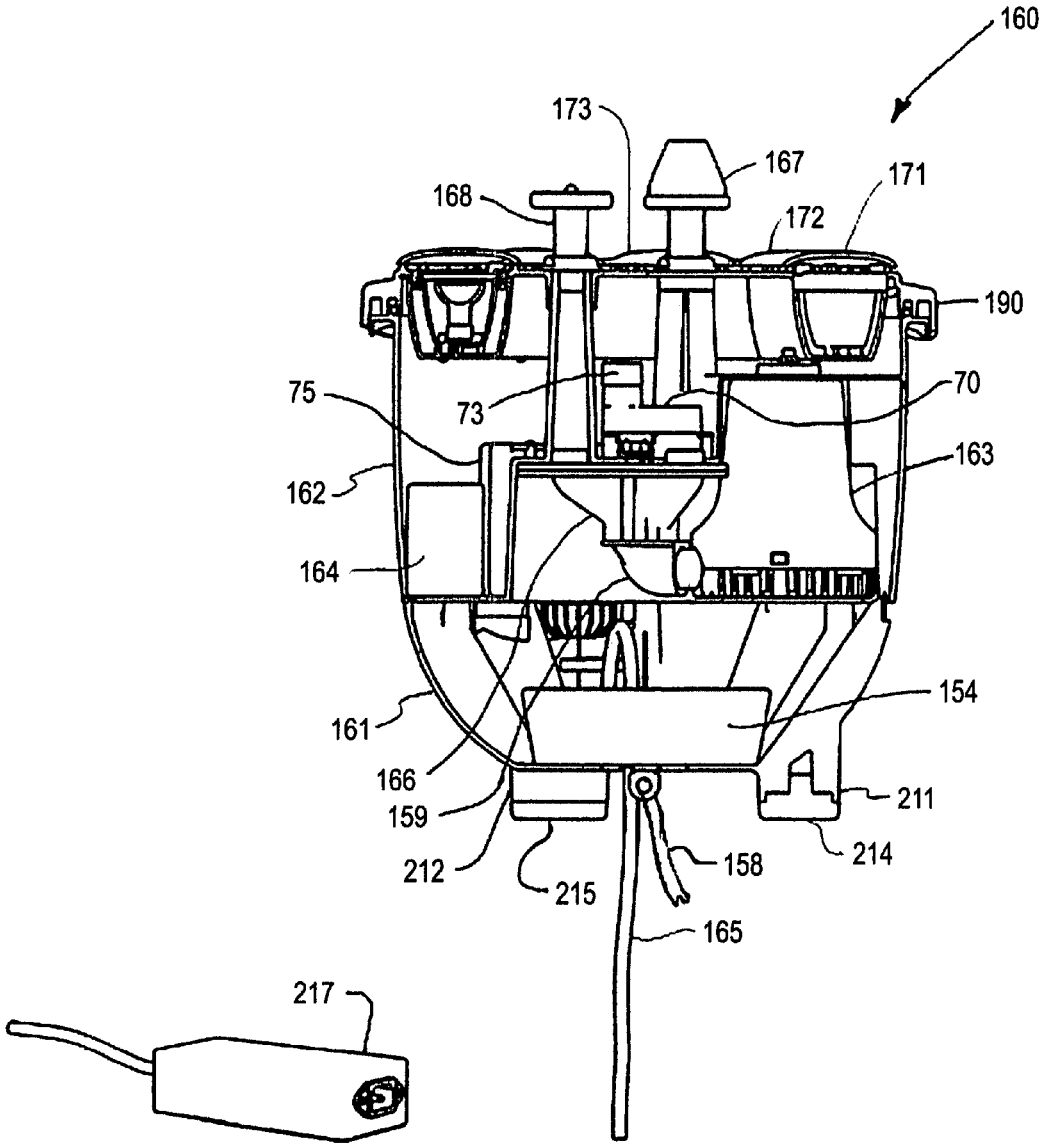
FIG. 5 sets forth a section view of an alternate embodiment of the present invention improved fountain having an on-board pump apparatus therein.

FIG. 5 sets forth a section view of an alternate embodiment of the present invention generally referenced by numeral 160. Fountain 160 is substantially identical to fountain 10 shown and described above with the differences being found in the utilization of an on-board pump 163 within the interior of fountain 160. Thus, fountain 160 is independently powered in that it does not require coupling to an external source of water flow under pressure but rather generates its own pressurized water flow. In all other respects, however, fountain 160 is substantially the same as fountain 10 described above.

More specifically, fountain 160 includes a lower housing 161 joined to an upper housing 162. An upper plate 190 is secured to the upper edge of upper housing 162 to complete the housing enclosure for fountain 160. Fountain 160 further includes a lens assembly 170 having a plurality of individual colored lenses 171 through 178 (seen in FIG. 7). Fountain 160 further supports a plurality of nozzles such as nozzles 167 and 168. Upper plate 190 is fabricated in the manner shown in FIG. 7 and is identical to upper plate 60 shown in FIG. 1A. Thus, upper plate 190 defines a plurality of lamp receptacles 191 through 198 (seen in FIG. 6A) which receive and support a plurality of lamp assemblies 181 through 188 (also seen in FIG. 6A).

Fountain 160 differs in the utilization of an on-board pump 163 together with a counterweight 164 and a lower weight 154. In addition, lower housing 161 differs from housing 100 shown in fountain 10 in that lower housing 161 supports a plurality of downwardly extending legs 210, 211 and 212 (leg 210 seen in FIG. 6C). Further, legs 210, 211 and 212 support respective feet 213, 214 and 215 (seen in FIG. 6C).

The use of an on-board pump 163 requires that a different coupler 159 be utilized in coupling the output water flow of pump 163 to nozzle flow distributor 166. Flow distributor 166 is identical to distributor 120 set forth above in FIGS. 2 and 3. Coupler 159 is required to properly direct water flow from pump 163 to the input of flow distributor 166. Fountain 160 also utilizes gear drive unit 70 having motor 73 to operate flow distributor 166 in the manner described above. A power cord 165 couples a source of power 217 to the operative units within fountain 160 including control module 75, pump 163 and the electric lamps within lamp assemblies 181 through 188 (not shown). This operative coupling will be understood to utilize conventional electrical wiring (not shown) which is employed in accordance with conventional wiring techniques.

A convenient operative benefit of fountain 160 is found in its ability to be placed upon a flat surface such as a patio or pool deck for service or storage. The buoyancy of fountain 160 allows it to float slightly above the surface of a pond or reflecting pool and thereafter operate to greatly enhance the aesthetic appeal of the area by providing lights and water flow in accordance with the user's preferences. An anchor and tether 158 is used to maintain the position of the fountain within its environment.

Figure 6A:
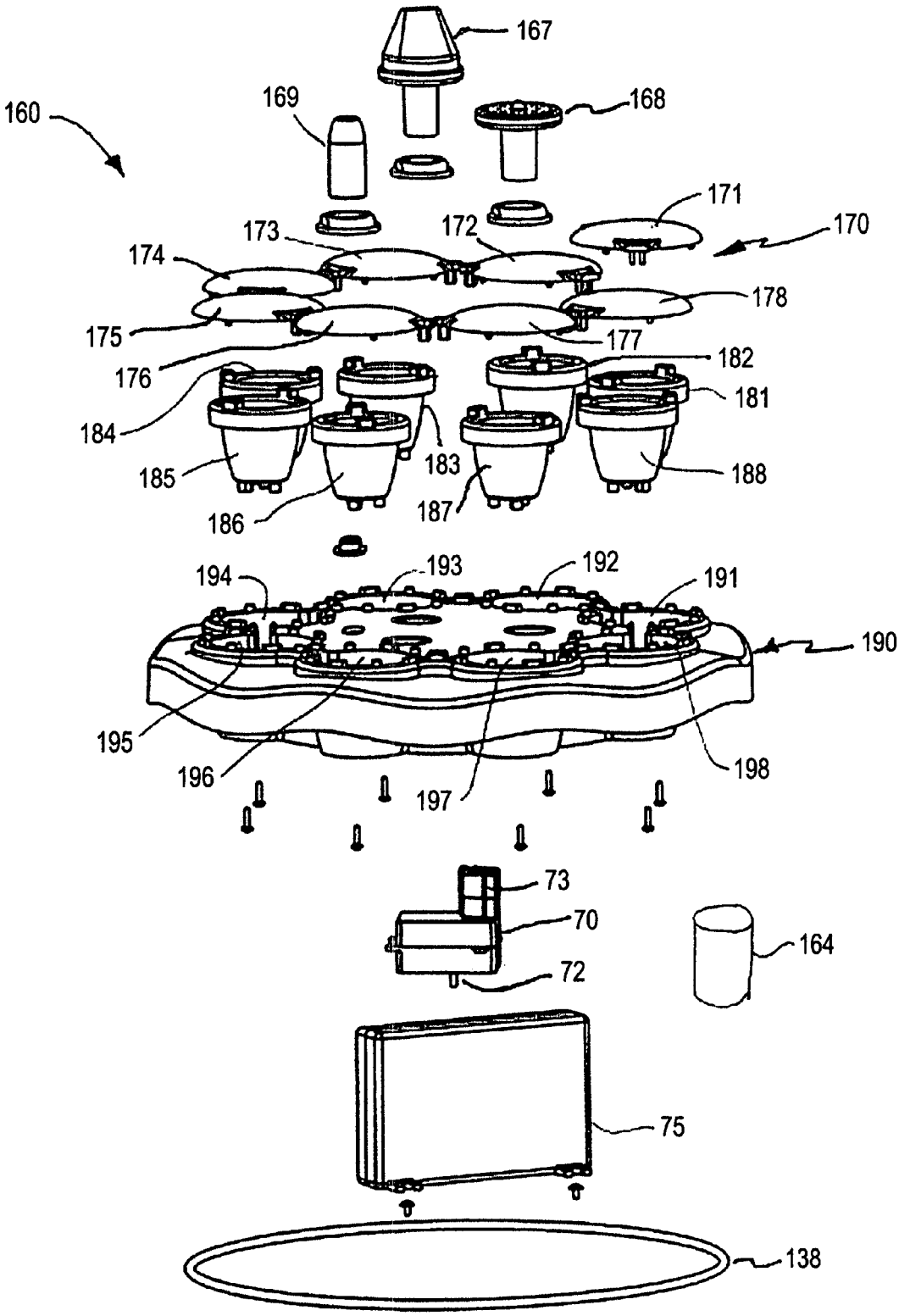
FIGS. 6A, 6B and 6C taken together set forth a perspective assembly view of the alternate embodiment of the present invention improved fountain shown in FIG. 5.
Figure 6B:
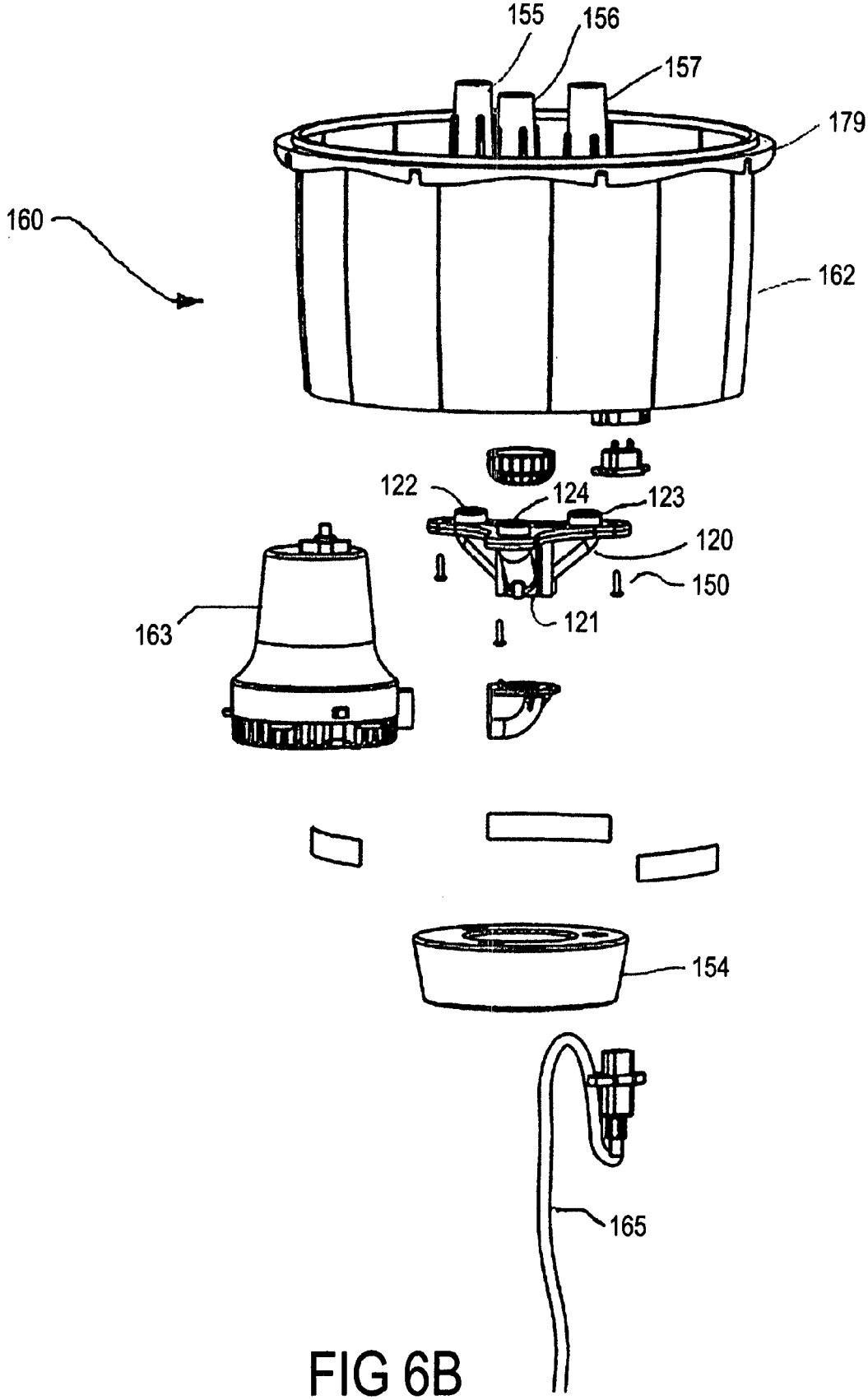
Figure 6C:
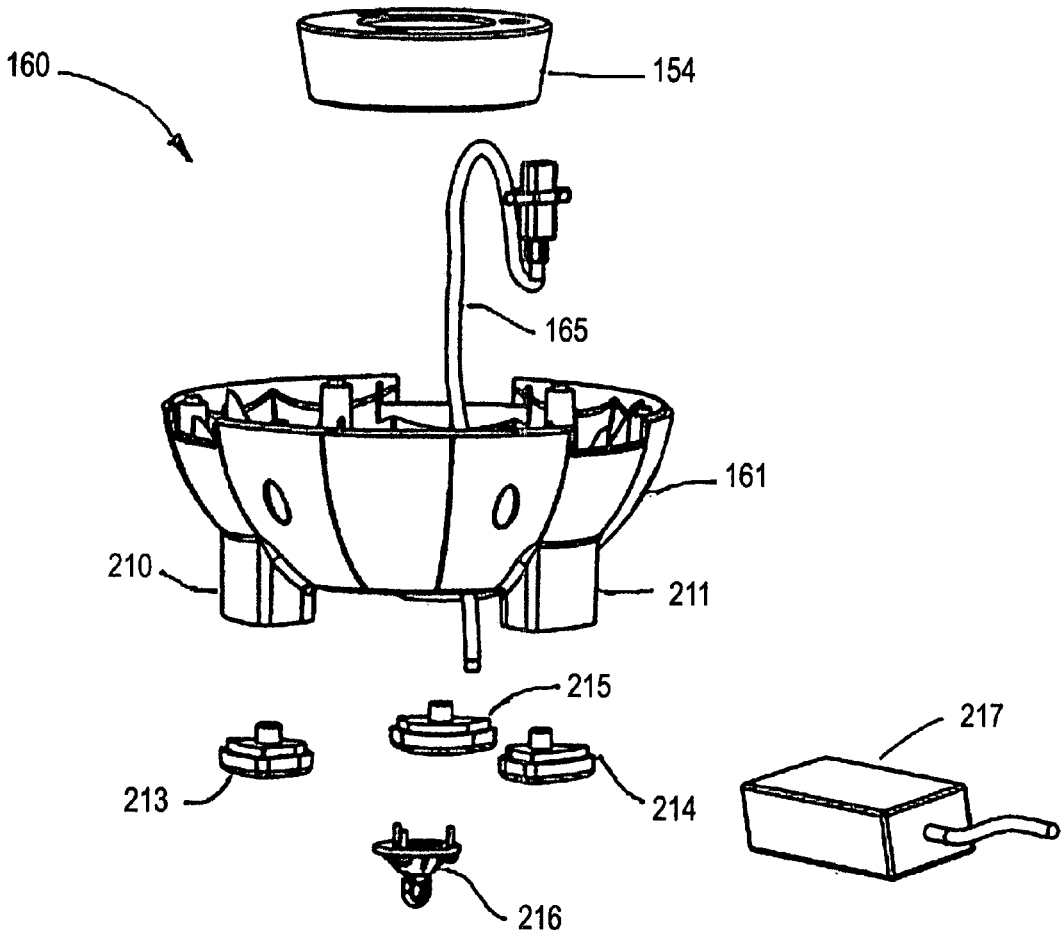

FIGS. 6A, 6B and 6C taken together set forth a perspective assembly view of fountain 160. It will be apparent to those skilled in the art that substantial portions of fountain 160 are similar or identical to the corresponding units set forth above in conjunction with fountain 10.

More specifically with reference to FIG. 6A, fountain 160 includes an upper plate 190 which defines a plurality of lamp receptacles 191 through 198. Fountain 160 further includes a plurality of lamp assemblies 181 through 188 received and supported within receptacles 191 through 198. A lens assembly 170 includes a plurality of individual colored or tinted lenses 171 through 178. As described above in conjunction with fountain 10, lens assembly 170 is received upon and secured to upper portion of plate 190 such that lenses 171 through 178 overlie lamp assemblies 181 through 188 respectively. A plurality of nozzles 167, 168 and 169 are secured to nozzle feed tubes 155, 156 and 157 in the above-described press-fit attachment.

Fountain 160 further includes a control module 75 together with a counterweight 164. Counterweight 164 is required to offset the weight provided by pump 163 (seen in FIG. 6B). As mentioned above, pump 160 also includes a gear drive unit 70 having a motor 73 identical to the gear drive unit utilized in the above-described fountain. A seal 138 is secured beneath upper plate 190 when upper plate 190 is joined to upper housing 162 (seen in FIG. 6B).

With specific reference to FIG. 6B, fountain 160 includes a generally cylindrical upper housing 162 having an upper flange 179. A plurality of nozzle feed tubes 155, 156 and 157 are supported within upper housing 162. Fountain 160 further utilizes a nozzle flow distributor 120 identical to the distributor set forth above and having an input 121 and a trio of outputs 122, 123 and 124. A pump 163 which is electrically operated under the control of control module 75 is coupled to input 121 of distributor 120 by a coupler 159. A center weight 154 is positioned beneath pump 163 and distributor 120 to further control the buoyancy and float level of fountain 160 within its water environment. A power cord 165 is utilized in coupling operative power to control module 75 (seen in FIG. 6A).

With specific reference to FIG. 6C, pump 160 includes a generally hemispherical lower housing 161 having a plurality of supporting legs 210, 211 and 212 (legs 212 seen in FIG. 5). A plurality of feet 213, 214 and 215 are secured to the lower edges of legs 210 through 212. An anchor fitting 216 is secured to the bottom center of housing 161. A power source 217 is coupled to a power cord 165 which provides operative power for fountain 160. As mentioned above, a center weight 154 is received within the lower center of housing 161 in the manner shown in FIG. 5.

The operation of fountain 160 is substantially the same as fountain 10 set forth and described above with the difference being found in the utilization of an on-board pump in place of operative coupling to an external source of pressurized water flow which fountain 10 depends upon. In all other respects, however, the function and operation of fountain 160 is substantially identical to fountain 10 and the descriptions thereof will be understood to apply equally well thereto.

Figure 7:
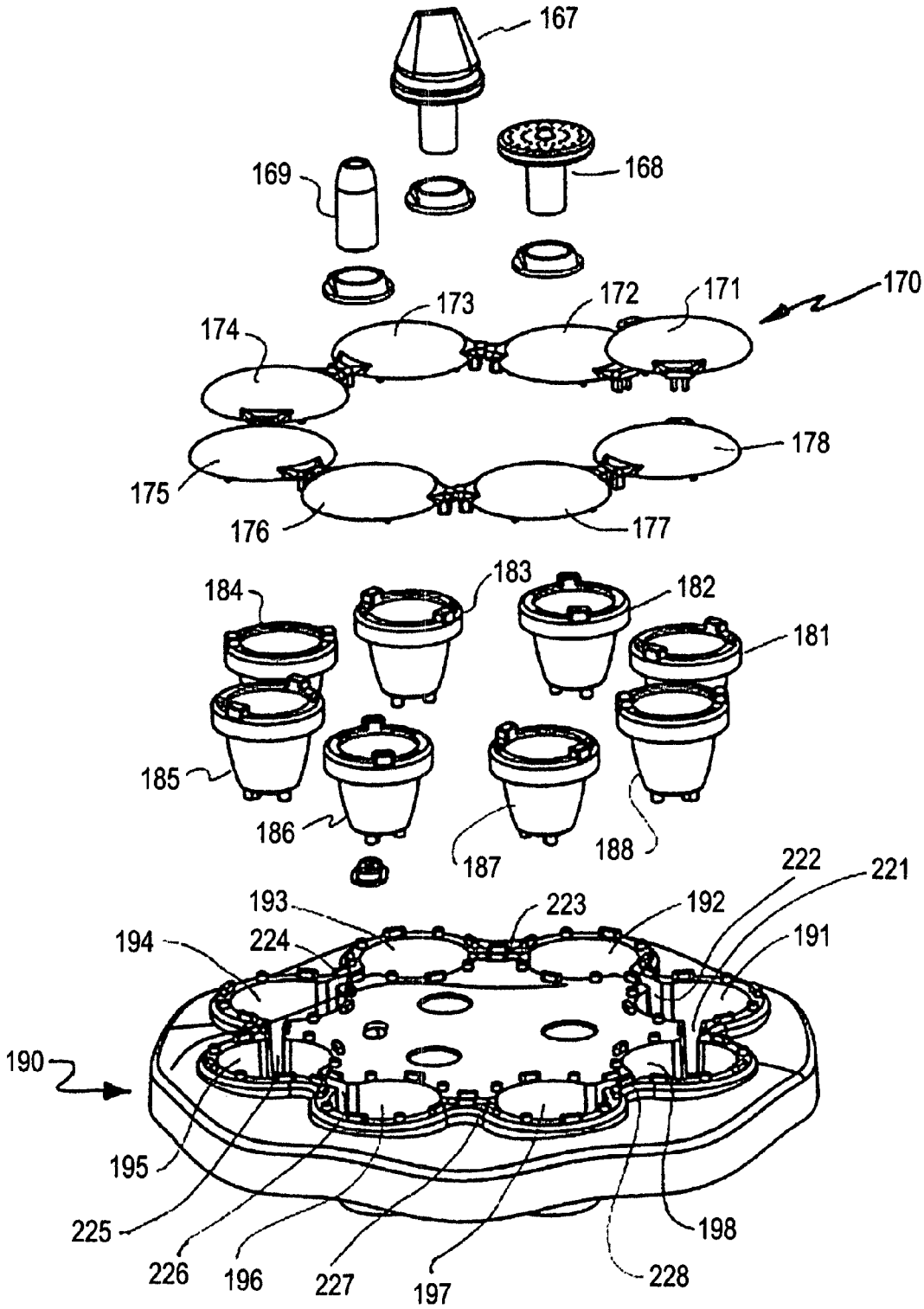
FIG. 7 sets forth an enlarged perspective assembly view of the upper plate and lamp assemblies together with nozzle assemblies of the present invention improved fountain.

FIG. 7 sets forth an enlarged perspective assembly view of the upper portion of fountain 160. As described above, fountain 160 includes an upper plate 190 defining a plurality of lamp receptacles 191 through 198. Of importance with respect to the present invention is the further presence of a plurality of interconnecting cooling channels 221 through 228 which interconnect receptacles 191 through 198. As mentioned above, receptacles 191 through 198 carry a flow of cooling water during the operation of the present invention fountain. This cooling water flow is of particular importance when the present invention fountain is operating to provide a plurality of colored light enhancements of the fountain sprays. Channel 221 connects receptacles 191 and 198 while channel 222 connects receptacles 191 and 192. Similarly, channel 223 couples receptacles 192 and 193 while channel 224 couples receptacles 193 and 194. In a similar fashion, channel 225 couples receptacles 194 and 195 while channel 226 couples receptacles 195 and 196. Channel 227 couples receptacles 196 and 197 while channel 228 couples receptacles 197 and 198. Thus, each of receptacles 191 through 198 is provided with a flow of cooling water which enhances the efficient and safe operation of the lamp assemblies within the present invention fountain.

Figure 8:
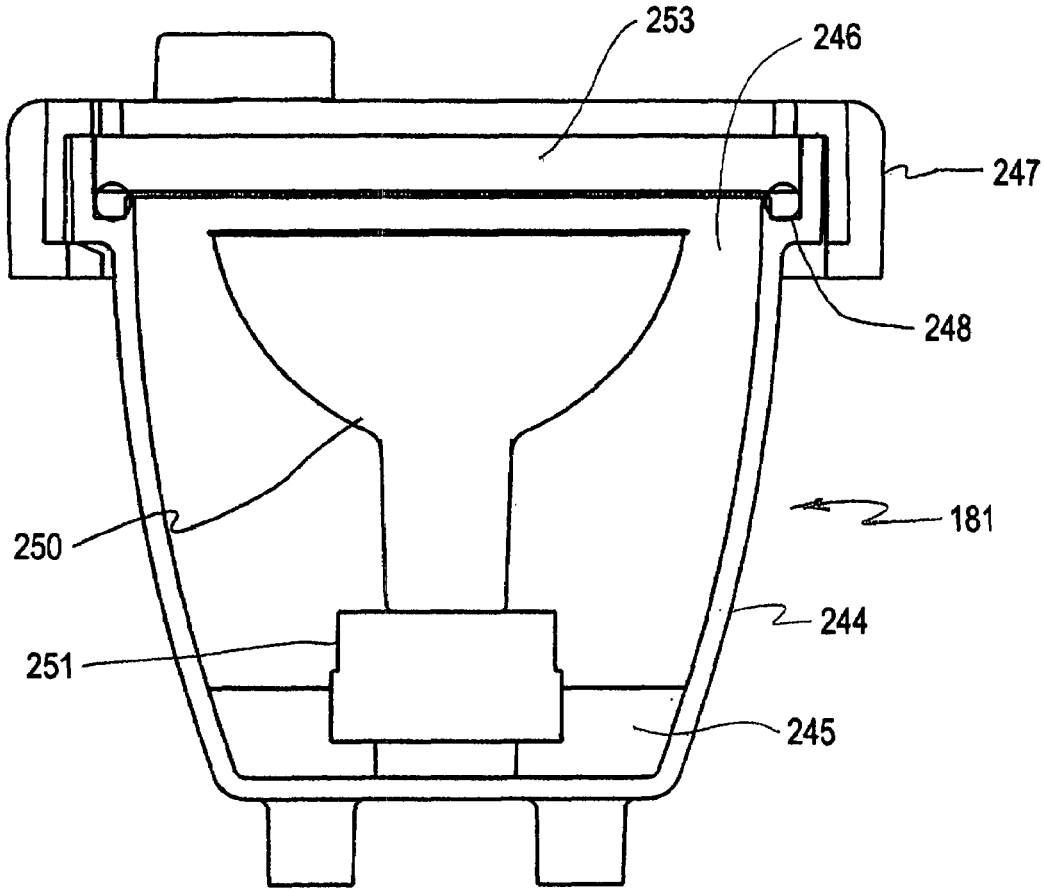
FIG. 8 sets forth an enlarged section view of an exemplary light housing and water cooling apparatus therefore.

FIG. 8 sets forth a section view of an illustrative lamp assembly. FIG. 8 shows the structure of lamp assembly 181. However, it will be understood by those skilled in the art that lamp assembly 181 is substantially identical to lamp assemblies 182 through 188 of fountain 160 as well as lamp assemblies 51 through 58 of fountain 10 (seen in FIG. 1A). Accordingly, the descriptions set forth in conjunction with FIGS. 8 and 9 will be understood to be equally applicable to the structures of the remaining lamp assemblies within fountains 10 and 160.

More specifically, lamp assembly 181 includes a housing 244 forming a base 245 therein. Assembly 181 further includes a cover attachment 247 securing a clear protective lens 253. A resilient seal 248 is captivated between cover 253 and the upper portion of housing 244 to maintain the water tight integrity of housing 244. A conventional lamp 250 which preferably comprises a "spotlight" or "floodlight" is supported within the interior of housing 244 by a socket 251. A plurality of electrical connections are made to socket 251 through a water tight connector (not shown) which is fabricated in accordance with conventional fabrication techniques. Thus, as heat is generated by lamp 250 within the interior of housing 244, heat is communicated to the outer surface of housing 244. This heat is subjected to the above-described cooling water flow to carry heat away from lamp assembly 181 and maintain lamp 250 and lamp assembly 181 within the safe and efficient operating temperature range to avoid overheating and potential damage to the present invention fountain.

Figure 9:
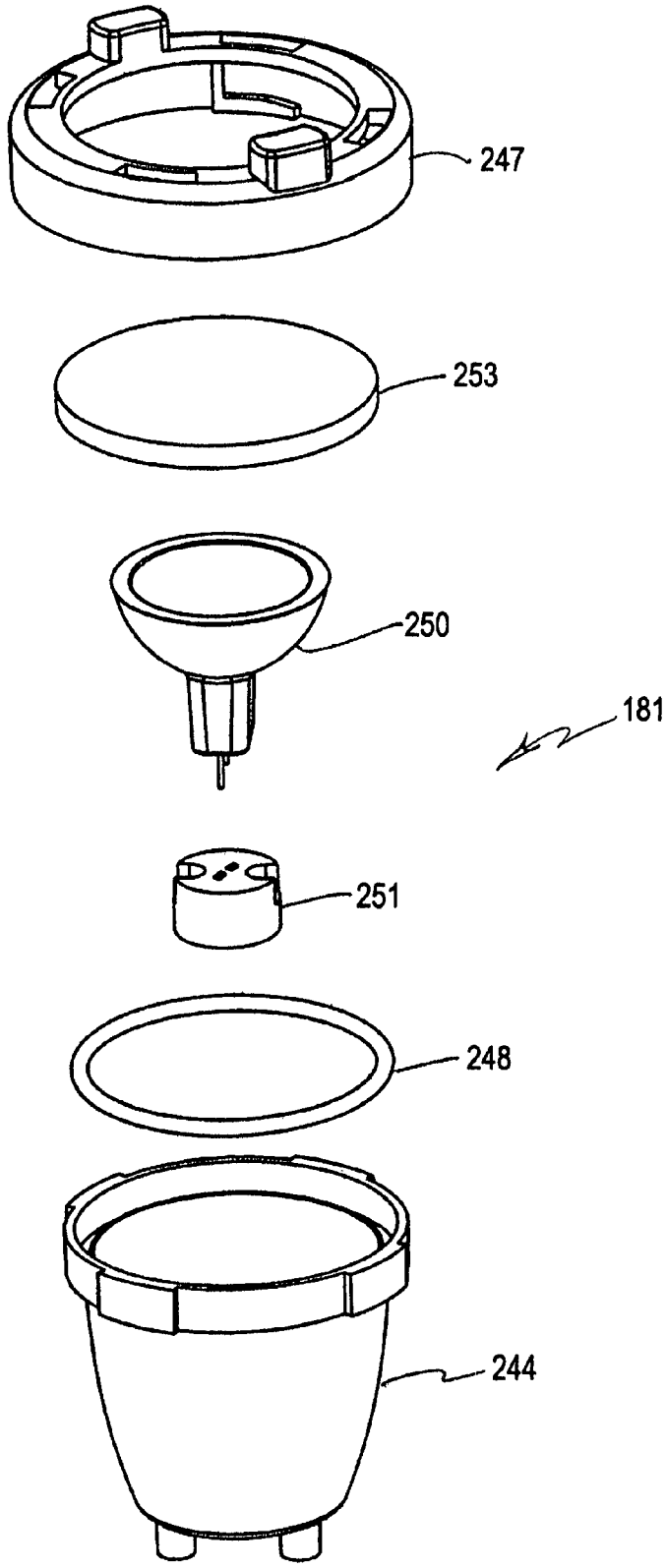
FIG. 9 sets forth a perspective assembly view of the lamp housing of FIG. 8.

FIG. 9 sets forth a perspective assembly view of lamp assembly 181. As described above, lamp assembly 181 includes a housing 244 having an upper edge which receives a resilient seal 248. A socket 251 is secured to the lower portion of housing 244 and receives a lamp 250. A lens 253 is positioned upon seal 248 and is secured thereto by an attachment 247.

Figure 10:
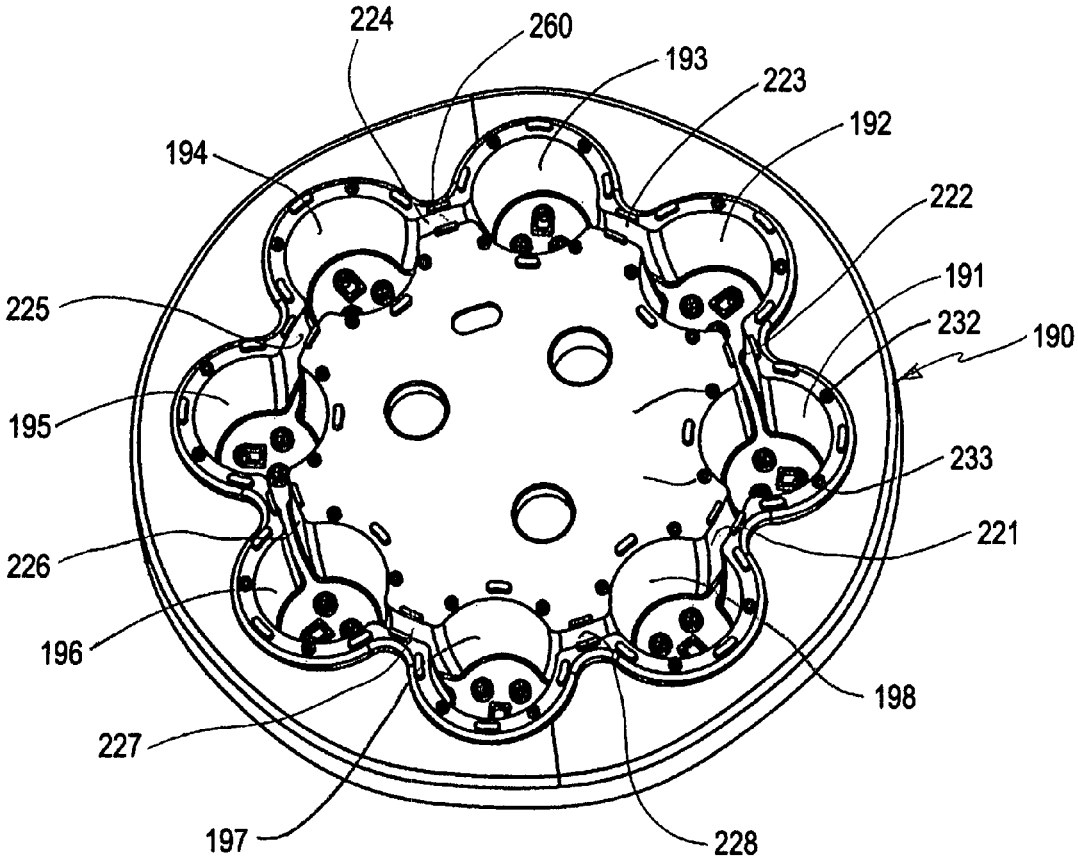
FIG. 10 sets forth an alternate perspective view of the upper plate portion of the present invention improved fountain.

FIG. 10 sets forth a perspective top view of upper plate 190. As mentioned above, upper plate 190 is substantially identical to upper plate 60 and thus the structure thereof will be understood to apply equally well to upper plate 60.

More specifically, FIG. 10 shows upper plate 190 in a top perspective view which facilitates examination of the various elements of the present invention found therein. As mentioned above, upper plate 190 includes a plurality of lamp receptacles 191 through 198 interconnected with respective cooling channels 221 through 228. As mentioned above, descending water spray flows into lamp receptacles 191 through 198. The cooling channel water flow is exceptionally important to provide the lamp cooling function of the present invention. In order to protect the present invention fountain from potentially damaging operation in the event water flow sufficient for cooling is not present, one or more water level sensors 260 are positioned within a selected one or selected ones of channels 221 through 228. The fabrication of water level sensors 260 utilizes conventional sensing units of the type readily available in the art. The present invention system is configured to terminate the operation of the lamps within the lamp assemblies in the event a low water level or absence of cooling water is sensed.

FIG. 11 sets forth a perspective lower view of a typical lens 171 showing the mounting apparatus used therein which secures lens 171 to plate 190. It will be apparent to those skilled in the art that the structure shown for lens 171 and its cooperating receptacle 191 (seen in FIG. 10) is identical to the individual lens and lens receptacles shown above in pumps 10 and 160. Thus, the descriptions set forth herein in connection with lens 171 will be understood will be understood to be equally descriptive and equally applicable to the remaining lens set forth in fountains 10 and 160.

More specifically, lens 171 includes a pair of downwardly extending spaced-apart flanges 85 and 86 together with a similar pair of downwardly extending spaced-apart flanges 87 and 88. Lens 171 further includes a plurality of downwardly extending generally cylindrical posts 91, 92, 93 and 94. With concurrent reference to FIGS. 10 and 11, it will be noted that lens 171 is assembled to plate 190 by fitting flanges 85 and 86 into cooling channel 221 while fitting flanges 87 and 88 into cooling channel 222. With this alignment, posts 91 and 92 are aligned with apertures 230 and 231 formed in plate 90 while post 93 and 94 are aligned with apertures 232 and 233 therein. Thus, lens 171 is simply press-fitted onto plate 190. The spaced-apart fabrication of flanges 85 and 86 and flanges 87 and 88 together with their relatively short lengths insures that cooling water is able to flow through cooling channels 221 and 222. As mentioned, the remaining lens are assembled within their respective lens receptacles in accordance with this fabrication.

Figure 12:
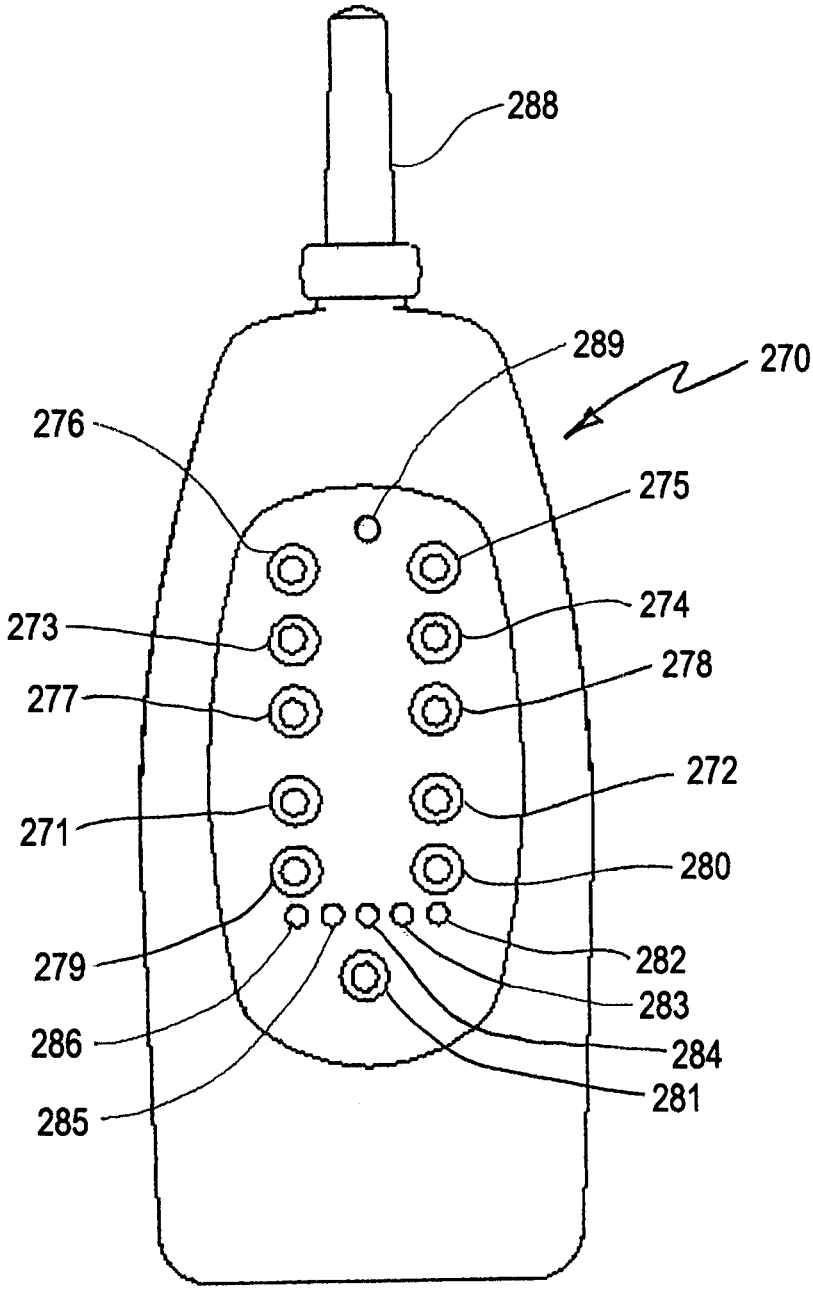
FIG. 12 sets forth a front view of a remote control unit constructed in accordance with the present invention.

FIG. 12 sets forth a front view of a remote controller 270 constructed in accordance with the present invention. Remote controller 270 operates utilizing the circuit set forth in FIG. 13. Remote controller 270 includes a plurality of user operated buttons each of which is depressible to input a particular remote control command to be processed by the circuit set forth in FIG. 13.

More specifically, remote controller 270 supports a main power button 281 together with a pump on/off button 271 and a light on/off button 272. Controller 270 further includes a transmission indicator light 289 and low pump button 273 and a high pump button 274 which are operative to set the operating level of the pump within the present invention fountain. Remote controller 270 further includes a nozzle select button 275 which is operative to increment the water distribution apparatus within the present invention fountain to the next nozzle in the operative sequence. An auto pump input 276 provides for the operation of the pump within the present invention fountain in accordance with a predetermined sequence of pump level changes.

A pair of time adjusting buttons 277 and 278 allow the time of pump operation to be adjusted. An auto lights 279 provides a command to the present invention fountain which causes the lights to be selectively changed in accordance with a predetermined sequence. A time select button 280 is utilized in selecting the time of operation of the present invention fountain. A plurality of condition indicating lights 282, 283, 284, 285 and 286 provide visible indication of the current timer setting for the operation of the present invention fountain.

Thus, utilizing remote controller 270, the user is able to access the operative circuitry set forth in FIGS. 13, 14 and 15 below to control the operation of the present invention fountain from a remote location.

In operation, the user initially operates 281 to turn on the system power for remote control. If no action is taken within two minutes, the system again returns to an off condition. Next the user utilizes button 271 to turn on the pump system and cause water to spray. The default condition for pump operation in the absence of selection is a cyclical routine of changing water spray. However, utilizing button 275 the user is able to select the water spray nozzle to be driven. Next, the user operates buttons 273 and 274 to adjust the height of water spray. Thereafter, buttons 277 and 278 are utilized in setting the time of operation. The default condition for the timer is one hour. During time set using time increase and decrease buttons 277 and 278, lights 282 through 286 indicate the timer setting. Once the time has been set, the fountain system cycles through a shut down and a turn on to indicate time has been set. Thereafter, the user utilizes button 272 to turn the lights of the fountain on or off. The default condition for light activation is a periodic light cycle. The user then employs button 279 to sequence through the available lights. Thereafter, the user presses button 280 to select the desired lights to be utilized. At this point, the system is completely set by remote control. Operation may be further changed by utilizing any of the foregoing control buttons to provide further input to the system using remote controller 270.

Figure 13:
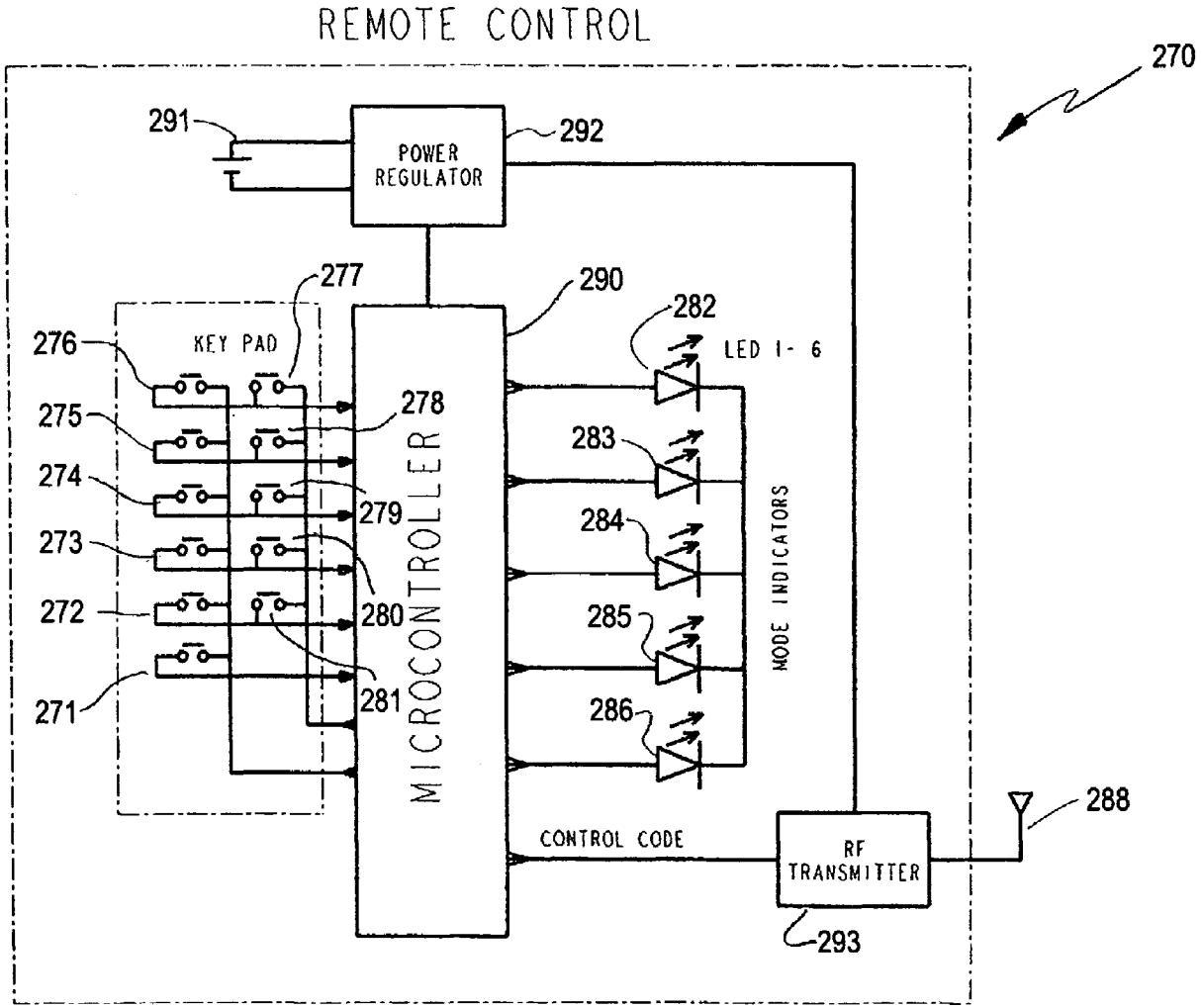
FIG. 13 sets forth a schematic diagram of the circuit within the remote control transmitter.

FIG. 13 sets forth the operative circuitry within remote control unit 270. Remote control unit 270 includes a microprocessor 290 constructed in accordance with conventional fabrication techniques and including an associated memory having a stored instruction set therein. Microcontroller 290 includes a plurality of input buttons 271 through 281 which function as described above in FIG. 12. Microcontroller 290 further includes a battery power source 291 and a power regulator 292. Regulator 292 provides a fixed operating voltage derived from battery 291 which is used to operate microprocessor 290 and RF transmitter 293. A plurality of light emitting diodes 282 through 286 function as described above in FIG. 12 to provide indication of timer settings.

Figure 14:
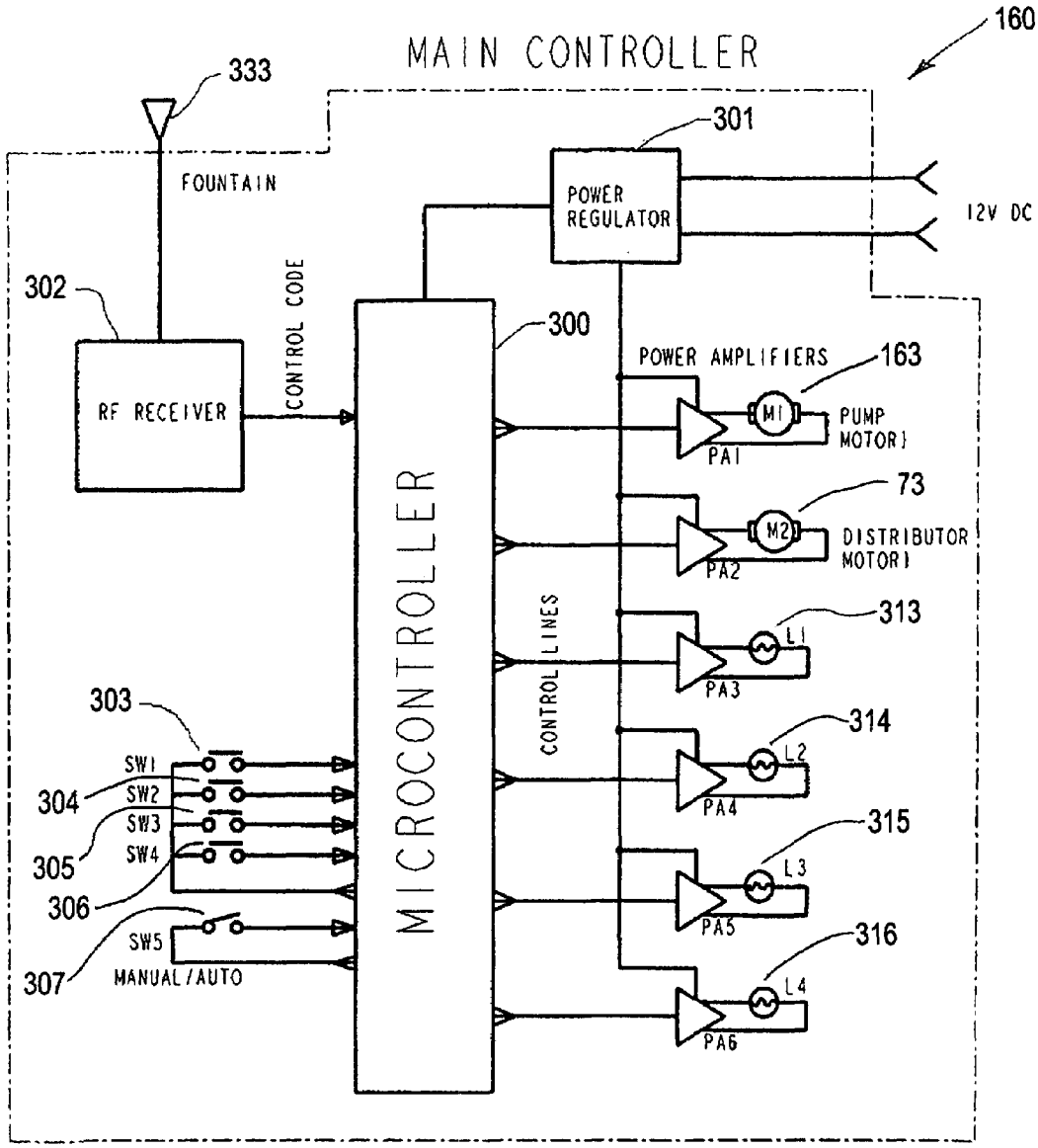
FIG. 14 sets forth a circuit diagram of the main controller utilized in the embodiment of the present invention having an internal pump.

FIG. 14 sets forth a schematic diagram of the main controller circuit for fountain 160. It will be recalled that fountain 160 utilizes an internal pump system rather than replying upon an external source of water under pressure as is the case with fountain 10. It will be further noted that the controller circuit of FIG. 14 utilized for fountain 160 is substantially the same as the controller circuit of FIG. 15 used for fountain 10 with the sole difference being found in the operative connection to pump motor control.

More specifically, a microprocessor 300 includes a power regulator 301 coupled to a source of operative 12 volt DC power (not shown). Microprocessor 300 is coupled to a radio frequency receiver 302 which in turn is coupled to a receiving antenna 303. Antenna 303 operates to receive remote control signals from remote control unit 270 (seen in FIG. 12). A plurality of input switches 303, 304, 305 and 306 are operatively coupled to microprocessor 300 to set input conditions for controller operation. In addition, a manual/auto input 307 is also coupled to microprocessor 300. Microprocessor 300 is further coupled to a plurality of indicator lights 313, 314, 315 and 316 which respond to operating condition of the controller to indicate the settings inputted by the user. Microprocessor 300 is further coupled to nozzle flow distributor motor 73 which, as is mentioned above, provides water flow selection between the plurality of fountain nozzles operative in the present invention fountain. Microprocessor 300 is further coupled to an internal pump motor 163 which is operative under microprocessor control to provide the water flow under pressure for the fountain nozzles of fountain 160.

Figure 15:
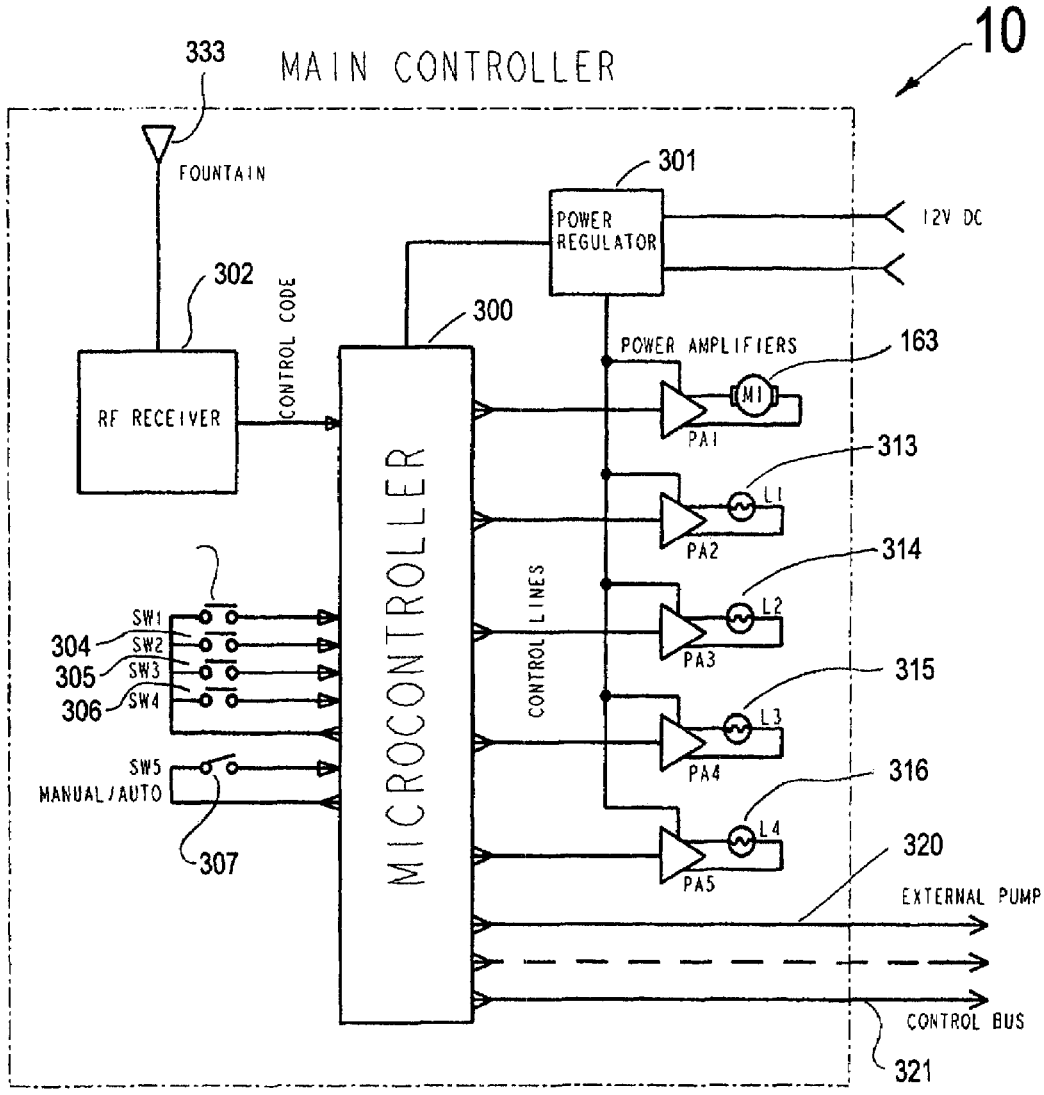
FIG. 15 sets forth a circuit diagram of the main controller of the present invention embodiment utilizing the external pump of the host pond or pool.

FIG. 15 sets forth a schematic diagram of the main controller operative within fountain 10. As mentioned above, the main controller for fountain 10 shown in FIG. 15 is substantially identical to the main controller described above in FIG. 14 with the difference being found in the control of the external pump system utilized in fountain 10.

More specifically, a microprocessor 300 includes a power regulator 301 coupled to a source of operative 12 volt DC power (not shown). Microprocessor 300 is coupled to a radio frequency receiver 302 which in turn is coupled to a receiving antenna 303. Antenna 303 operates to receive remote control signals from remote control unit 270 (seen in FIG. 12). A plurality of input switches 303, 304, 305 and 306 are operatively coupled to microprocessor 300 to set input conditions for controller operation. In addition, a manual/auto input 307 is also coupled to microprocessor 300. Microprocessor 300 is further coupled to a plurality of indicator lights 313, 314, 315 and 316 which respond to operating condition of the controller to indicate the settings inputted by the user. Microprocessor 300 is further coupled to nozzle flow distributor motor 73 which, as is mentioned above, provides water flow selection between the plurality of fountain nozzles operative in the present invention fountain. Microprocessor 300 is further coupled to a pump output 320 and a control bus output 321 which provide operative control of the external pump motor of the host system to which fountain 10 is connected. This external pump system within the host environment is not shown but will be understood to be constructed in accordance with conventional fabrication techniques.

What has been shown is a novel improved multi-spray multi-light fountain suitable for use with existing high pressure water supplies of a host pool or pond as well as suitable for use without the need of a pressurized water supply. The improved fountain provides simultaneous flow and light shows which have substantial aesthetic appeal to the user.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A floating fountain for use in a water environment such as a pool or pond, said fountain comprising:

a housing defining an upper flange and an interior cavity;

an upper plate secured to said upper flange defining a plurality of lamp receptacles;

a plurality of lamp assemblies each having a lamp housing supported with said lamp receptacle and a lamp sealed within said lamp housing;

a plurality of cooling spaces formed between said lamp receptacles and said lamp housings;

a plurality of colored lenses and means for supporting said lenses above said upper plate in general alignment with said lamps, said colored lenses, said upper plates and said means for supporting constructed to provide a cooling water flow path into said cooling spaces with said lamp receptacles;

a plurality of upwardly directed spray nozzles; and means for directing water pressure to said spray nozzles to cause water to spray upwardly and descendingly.

2. The fountain set forth in claim 1 wherein said upper plate defines top surfaces generally about said lamp receptacles and wherein said means for supporting position said colored lens above said surfaces to provide a gap therebetween for form said cooling water flow path by which descending spray from said nozzles flows into said lamp receptacles.

3. The fountain set forth in claim 2 wherein said housing further includes at least one weight to create a buoyancy for said fountain such that said upper plate is slightly above the water surface of the pool or pond and wherein said upper plate defines a plurality of cooling channels interconnecting each of said lamp receptacles with its adjacent lamp receptacles.

4. The fountain set forth in claim 3 wherein said means for directing includes:

a nozzle flow distributor having a housing defining a single input and plural outputs each coupled to one of said spray nozzles and a movable flow control rotor; and a motor and gear drive coupled to and rotating said flow control rotor.

5. The fountain set forth in claim 4 wherein said nozzle flow distributor input is coupled to an external source of pressurized water flow.

6. The fountain set forth in claim 4 wherein said means for directing includes an internal pump, having an output coupled to said nozzle flow distributor input, and a pump motor.

7. The fountain set forth in claim 5 further including a main controller operable to control said nozzle flow distributor, said lamps and said pump motor.

8. The fountain set forth in claim 7 wherein said main controller includes a remote control signal receiver and wherein said fountain further includes a remote controller for providing remote control signals to said main controller.

9. The fountain set forth in claim 5 further including a main controller operable to control said nozzle flow distributor, said lamps and said external source.

10. The fountain set forth in claim 9 wherein said main controller includes a remote control signal receiver and wherein said fountain further includes a remote controller for providing remote control signals to said main controller.

11. The fountain set forth in claim 4 wherein said nozzle flow distributor input is coupled to an external source of pressurized water flow.

12. The fountain set forth in claim 11 wherein said means for directing includes an internal pump, having an output coupled to said nozzle flow distributor input, and a pump motor.

13. The fountain set forth in claim 1 further including a main controller operable to control said nozzle flow distributor, said lamps and said pump motor.

14. The fountain set forth in claim 13 wherein said main controller includes a remote control signal receiver and wherein said fountain further includes a remote controller for providing remote control signals to said main controller.

15. The fountain set forth in claim 1 further including a cooling water sensor supported within said upper plate for turning said lamps off in the absence of cooling water at said lamp receptacles.

* * * * *